US005105511A

United States Patent [19]

Shahin et al.

[11] Patent Number: 5,105,511

[45] Date of Patent: Apr. 21, 1992

[54] BELT BUCKLE

[76] Inventors: Thomas J. Shahin; Laraine E. Shahin, both of 32182 Sea Island Dr., Monarch Beach, Calif. 92677

[21] Appl. No.: 719,756

[22] Filed: Jun. 24, 1991

[51] Int. Cl.[5] ..... A44B 11/00

[52] U.S. Cl. ..... 24/198; 24/163 K; 24/200

[58] Field of Search ..... 24/198, 197, 200, 163 K, 24/3 A, 519, 490, 321

[56] References Cited

U.S. PATENT DOCUMENTS

| | | | |
|---|---|---|---|
| 4,896 | 5/1872 | Swett | 24/198 |
| 244,776 | 7/1881 | Wales | 24/198 |
| 323,866 | 8/1885 | Fuechsel . | |
| 429,778 | 6/1890 | Shelby | 24/200 |
| 703,300 | 6/1902 | Richardson | 24/198 |
| 825,395 | 7/1906 | Kennelly et al. . | |
| 886,732 | 5/1908 | Sawtell . | |
| 1,406,770 | 2/1922 | Smith | 24/198 |
| 1,541,701 | 6/1925 | Gaunt . | |
| 1,636,925 | 7/1927 | Ravigneaux | 24/200 |
| 1,780,931 | 11/1930 | Konigsberger . | |
| 2,983,007 | 5/1961 | Gross | 24/198 |
| 3,104,436 | 9/1963 | Ostolaba | 24/198 |
| 3,570,077 | 3/1971 | Hawie | 24/198 |
| 4,052,773 | 10/1977 | Nesbitt | 24/163 K |
| 4,484,379 | 11/1984 | Appelt et al. . | |
| 4,897,888 | 2/1990 | Broersma et al. | 24/519 |

FOREIGN PATENT DOCUMENTS

| | | | |
|---|---|---|---|
| 1008710 | 5/1952 | France | 24/198 |

*Primary Examiner*—Victor N. Sakran

*Attorney, Agent, or Firm*—Harris, Kern, Wallen & Tinsley

[57] ABSTRACT

A belt buckle having a body with a top and a bottom with a transverse bar at one end for attachment of a belt and defining a belt axis, and inlet and outlet slots for the belt with the slots spaced from each other and defining a belt path oblique to the belt axis so that a belt inserted through the inlet and outlet slots will be at an oblique angle to the fixed end of the belt at the attachment member.

10 Claims, 3 Drawing Sheets

FIG. 3
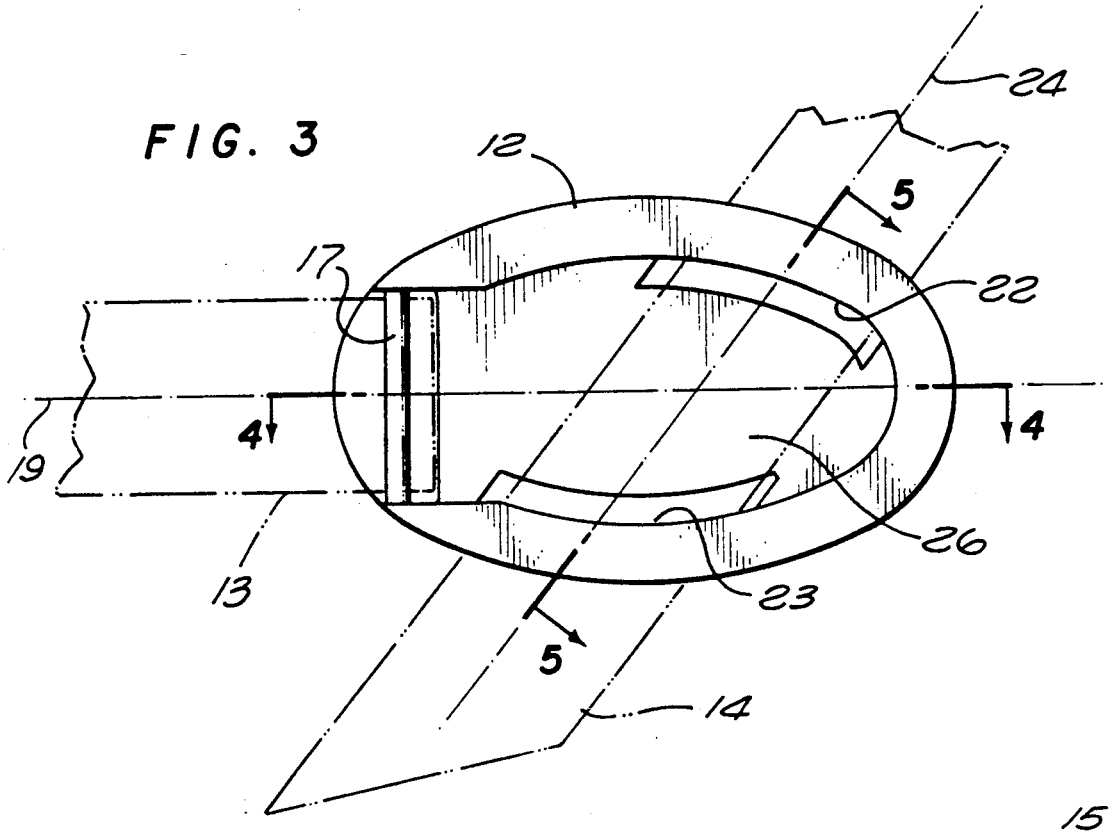
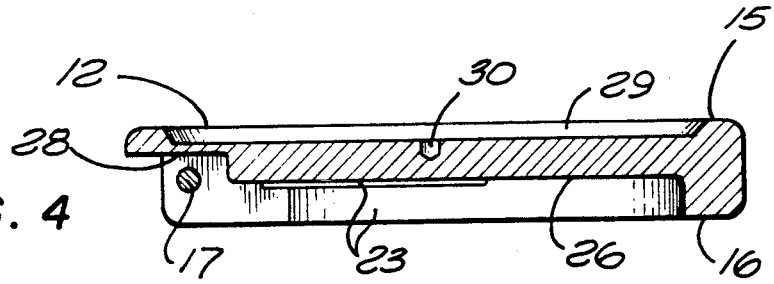
FIG. 4
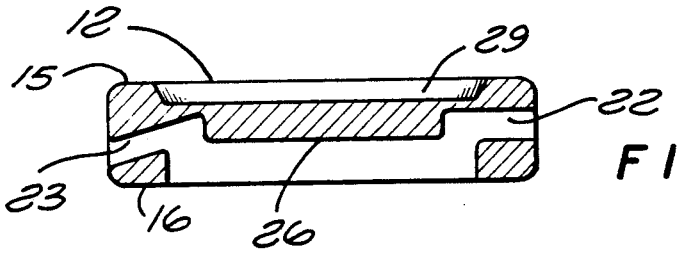
FIG. 5
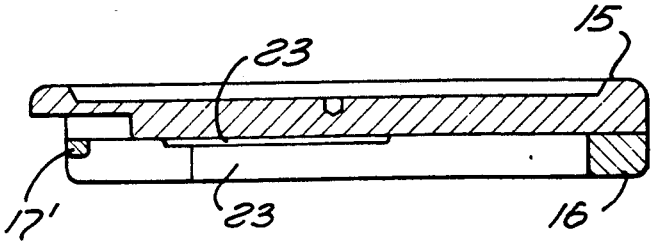
FIG. 6

FIG. 7
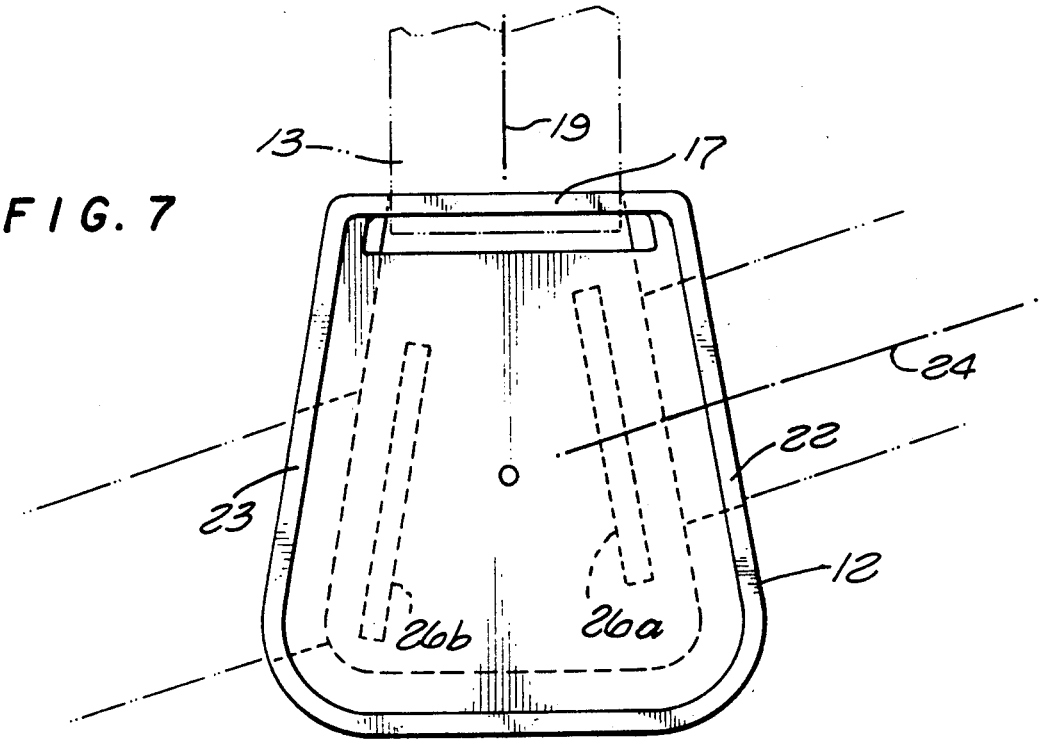
FIG. 8
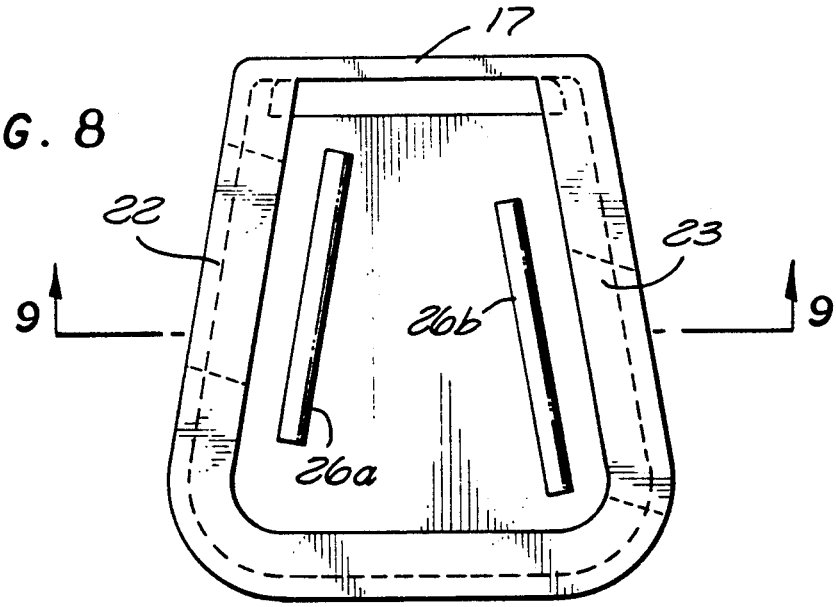
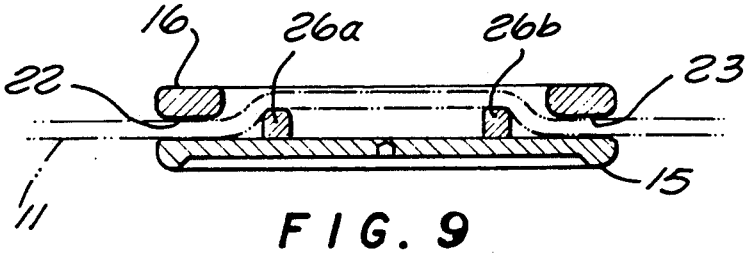
FIG. 9

BELT BUCKLE

BACKGROUND OF THE INVENTION

This invention relates to a new and improved buckle for belts of the type typically worn around the waist of a person.

A conventional buckle, regardless of its specific shape has a member at one end for attachment of the fixed end of a belt, and some arrangement at the opposite end for receiving and retaining the free end of the belt. The free end of the belt is passed through one or more openings in the buckle and lies over or under the opposite end of the belt which is attached to the buckle, and is retained in the buckle by some form of hook or pressure configuration.

This type of construction provides a circular or band configuration for the belt and buckle. However sometimes it is desirable to have a different configuration for the belt and buckle combination, and one such configuration is illustrated in FIG. 1, with the free end of the belt passing through the buckle at an angle to the fixed end of the belt.

It is an object of the present invention to provide a new and improved belt buckle which can be used to achieve this angled configuration when the free end of the belt is engaged with the buckle.

Other objects, advantages, features and results will more fully appear in the course of the following description.

SUMMARY OF THE INVENTION

The presently preferred embodiment of the invention comprises a buckle having a body with a top and bottom and a member for attachment of one end of a belt to the buckle and defining a belt axis. The buckle also includes inlet and outlet slots for passage of the free end of the belt therethrough, with the slots spaced from each other and defining a belt path oblique to the belt axis. A shoulder configuration is incorporated in the body between the slots to define a multi-level belt path through the body to provide improved restraint of the belt in the buckle.

The buckle may be made as a single unitary piece or in several pieces, such as a sandwich with the portions of the sandwich defining the slots. The body of the belt may be made in various shapes, typically oval or horseshoe. If desired, provision for attachment of a decorative panel to the top of the buckle may be incorporated.

BRIEF DESCRIPTION OF THE DRAWINGS

FIG. 3 is a bottom view of the buckle of FIG. 2;

FIG. 4 is a sectional view taken along the line 4—4 of FIG. 3;

FIG. 5 is a sectional view taken along the line 5—5 of FIG. 3;

FIG. 6 is a view similar to that of FIG. 4 showing an alternative construction of the buckle;

FIG. 7 is a top view of an alternative embodiment of the buckle of FIG. 3;

FIG. 8 is a bottom view of the buckle of FIG. 7; and

FIG. 9 is a sectional view taken along the line 9—9 of FIG. 8.

DESCRIPTION OF THE PREFERRED EMBODIMENTS

Figure 1:
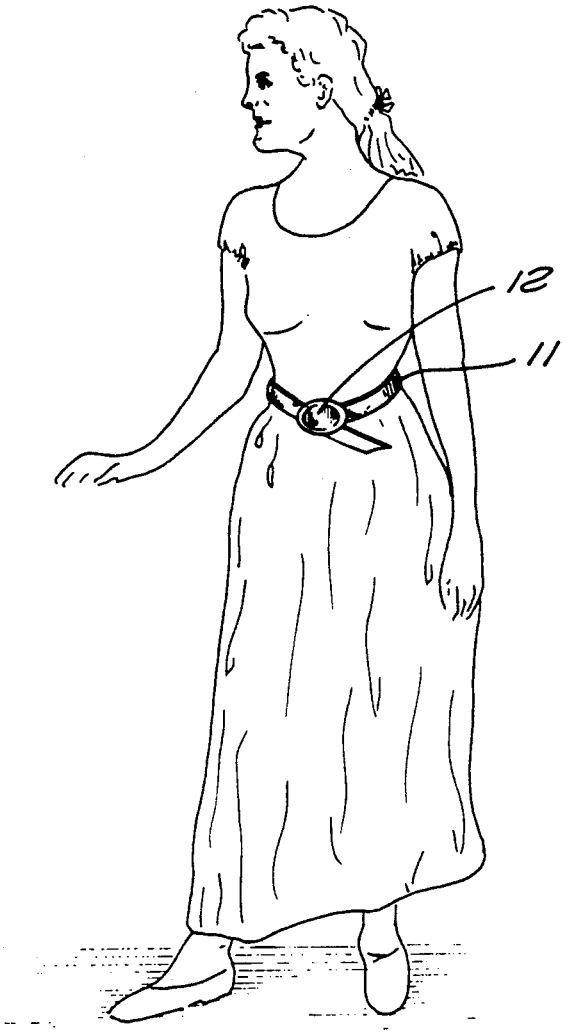
FIG. 1 is a view of a person wearing a belt with a buckle incorporating the presently preferred embodiment of the invention.
Figure 2:
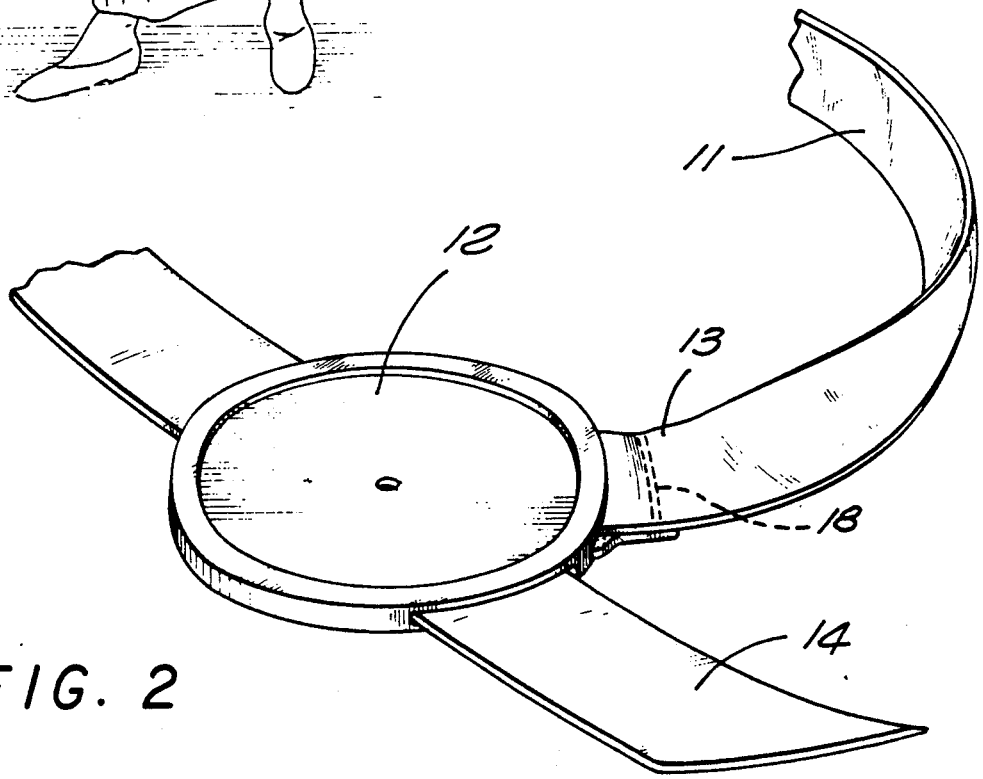
FIG. 2 is an enlarged partial view of the belt and buckle of FIG. 1 showing the top of the buckle.

The person in FIG. 1 is wearing a belt 11 with a buckle 12. The fixed end 13 of the belt is attached to the buckle 12, and the free end 14 of the belt passes through the buckle, as shown in FIG. 2.

The construction of the preferred embodiment of the buckle is best seen in FIGS. 3–5. The buckle has a top 15 and a bottom 16, with an attachment member such as a pin 17, for attachment of the fixed end of the belt. The belt may be attached in the conventional manner, as by stitching 18 or gluing or snaps or clips or otherwise as desired. The attachment of the fixed end of the belt to the buckle defines a belt axis 19.

An inlet slot 22 and an outlet slot 23 are formed in the buckle, with the slots generally parallel and defining a belt path 24, which path is oblique to the belt axis 19.

A plateau or shoulder 26 is provided in the body of the buckle between the slots 22, 23. The belt path through the buckle includes an inlet slot portion at a first level, a central portion defined by the shoulder at a second level, and an outlet slot portion at a third level, as best seen in FIG. 5. In the preferred embodiment, the inlet and outlet slot levels are substantially the same level and also, the outlet slot is disposed at an angle relative to the inlet slot. Further, in the preferred embodiment the shoulder 26 only partially obstructs the direct path between the inlet slot and outlet slot, as best seen in FIG. 4.

In the preferred embodiment illustrated in FIGS. 3–5, the attachment member or pin 17 is positioned in a cavity 28 formed in the body below the top 15 so that the major portion of the loop at the fixed end of the belt is concealed from the viewer. Further in the preferred embodiment, another cavity 29 is formed in the top of the buckle for receiving a decorative plate or other object, with an attachment hole 30 provided. Of course, other forms of decoration and attachment thereof can be utilized as desired. Alternatively, the top of the buckle can directly incorporate such decorative design.

In use, the free end of the belt is inserted through the inlet slot 22, over the shoulder 26 and out the outlet slot 23. This arrangement provides for a secure connection of the free end of the belt to the buckle and also provides the oblique installation of the belt through the buckle, as shown in FIGS. 1 and 2.

The buckle as shown in FIGS. 3–5 is made as a single unitary piece, typically by molding or casting. The pin 17 can be molded integrally with the rest of the buckle or can be inserted through drilled holes at a later time. An alternative configuration is shown in FIG. 6 where the top 15 and bottom 16 are formed of separate pieces which may be joined by an adhesive or screws or otherwise as desired. With this form of construction, the belt attachment member is preferably formed as a bar 17 integral with the bottom. Also in this configuration, the slots preferably are notched out of the lower surface of the top, with the bottom providing the closure over the notches to form the slots.

The specific shape of the body is not a necessary feature of the invention. In the buckle of FIGS. 1–6, the body is oval. An alternative horseshoe configuration is shown in FIGS. 7–9, where components corresponding to those of the embodiment of FIGS. 1–6 are identified by the same reference numerals. In the embodiment of FIGS. 7–9, the shoulder or plateau 26 is formed by two bars 26*a*, 26*b*, with the construction and use of the buckle otherwise the same as that of the embodiment of FIGS. 1–6.

We claim:

1. A belt buckle having a body with a top and a bottom, attachment means for attaching one end of a belt to said buckle and defining a belt axis, and inlet and outlet means defining inlet and outlet slots, respectively, in said body for passage for a belt therethrough, with said slots spaced from each other and defining a belt path oblique to said belt axis, said body including shoulder means between said slots defining a central portion of said belt path in a plane parallel with said top and bottom, with the inlet slot portion of said belt path in a plane parallel with said top and bottom, with the inlet slot portion of said belt path at a first level, said central portion at a second level, and the outlet slot portion at a third level, with said inlet and outlet slot portions extending along said belt path generally parallel with said central portions and defining S-shaped segments in said belt path.

2. A buckle as defined in claim 1 wherein said first and third levels are at substantially the same level.

3. A buckle as defined in claim 1 wherein said outlet slot is at an angle relative to said inlet slot.

4. A buckle as defined in claim 1 with said top and bottom of a single piece forming a unit body with a closed central portion.

5. A buckle as defined in claim 1 with said top and bottom formed of separate pieces defining said slots therebetween with a closed central portion.

6. A buckle as defined in claim 1 wherein said attachment means is a transverse bar formed integral with said body.

7. A buckle as defined in claim 1 wherein said attachment means is a transverse pin mounted in said body.

8. A buckle as defined in claim 1 wherein said shoulder only partially obstructs said path between said inlet and outlet slots.

9. A buckle as defined in claim 1 wherein said body is an oval shape.

10. A buckle as defined in claim 1 wherein said body is a horseshoe shape.

* * * * *